US010538925B2

(12) United States Patent
Ghelfi

(10) Patent No.: US 10,538,925 B2
(45) Date of Patent: Jan. 21, 2020

(54) KNOB COUPLABLE TO A SPACER-LEVELLER OF TILES FOR LAYING THE TILES ON FLAT SURFACES

(71) Applicant: GHELFI S.r.l., Bologna (IT)

(72) Inventor: Stefano Ghelfi, Bologna (IT)

(73) Assignee: GHELFI S.R.L., Bologna (IT)

( * ) Notice: Subject to any disclaimer, the term of this patent is extended or adjusted under 35 U.S.C. 154(b) by 0 days.

(21) Appl. No.: 16/287,548

(22) Filed: Feb. 27, 2019

(65) Prior Publication Data

US 2019/0271167 A1 Sep. 5, 2019

(30) Foreign Application Priority Data

Mar. 1, 2018 (IT) ..... 102018000003175

(51) Int. Cl.

| | |
|---|---|
| ***E04F 21/00*** | (2006.01) |
| ***E04F 21/18*** | (2006.01) |
| ***E04F 15/02*** | (2006.01) |
| ***E04F 13/08*** | (2006.01) |

(52) U.S. Cl.

CPC ..... *E04F 21/0092* (2013.01); *E04F 13/0892* (2013.01); *E04F 15/02022* (2013.01); *E04F 21/1844* (2013.01); *E04F 21/1877* (2013.01)

(58) Field of Classification Search

CPC ... E04F 21/0092; E04F 21/22; E04F 21/1877; E04F 15/02022; E04F 13/0892; E04F 21/1844

See application file for complete search history.

(56) References Cited

U.S. PATENT DOCUMENTS 4,397,125 A * 8/1983 Gussler, Jr. ..... E04F 21/0092 52/127.3
5,350,399 A * 9/1994 Erlebacher ..... A61B 17/0057 128/899

(Continued)

FOREIGN PATENT DOCUMENTS

EP 2549030 A2 * 1/2013 ..... E04F 21/0092
WO WO-2013023236 A1 * 2/2013 ..... E04F 21/0092

(Continued)

*Primary Examiner* — Adriana Figueroa
*Assistant Examiner* — Jessie T Fonseca
(74) *Attorney, Agent, or Firm* — R. Neil Sudol; Henry D. Coleman

(57) ABSTRACT

A knob is screwable to a tile spacer-leveler for together defining a tile alignment device. The knob comprises (i) a body, (ii) elastically-deformable connectors on the knob body, (iii) first and second fixing elements comprising respective threaded slots, supported by the connectors and arrangeable in a first arrangement wherein the threaded rod of a tile separator can be inserted into and removed from the threaded slots without screwing in a second arrangement in which the rod insertion and removal takes place only by screwing, (iv) a blocking element separated from the knob body for elastically deforming the connectors to change the arrangement of the first and second fixing elements to (a) insert the rod between the threaded slots of the first and second fixing means without screw-tightening thereof, (b) screw the knob to the threaded rod with the fixing elements in the second arrangement to align the tiles, and (c) remove the threaded rod without screwing.

10 Claims, 7 Drawing Sheets

(56) References Cited

U.S. PATENT DOCUMENTS

| | | | | |
|---|---|---|---|---|
| 7,946,093 | B1 * | 5/2011 | Sturino | E04F 21/0092 33/527 |
| 8,689,521 | B1 * | 4/2014 | Hoffman | E04F 13/0889 52/747.11 |
| 9,279,259 | B1 * | 3/2016 | Russo | E04F 21/20 |
| 9,322,185 | B1 * | 4/2016 | Russo | E04F 21/0092 |
| 9,482,018 | B2 * | 11/2016 | Torrents I Comas | E04F 21/22 |
| 9,482,019 | B2 * | 11/2016 | Fontana | E04F 13/0892 |
| 10,053,872 | B2 * | 8/2018 | Sighinolfi | E04F 21/0092 |
| 10,260,243 | B1 * | 4/2019 | Chen | E04F 21/0092 |
| 2013/0067854 | A1 * | 3/2013 | Bordin | E04F 21/0092 52/749.11 |
| 2013/0104497 | A1 * | 5/2013 | Ross | E04F 21/185 52/749.11 |
| 2015/0184355 | A1 * | 7/2015 | Wang | E02D 35/005 52/126.1 |
| 2015/0267420 | A1 * | 9/2015 | Fontana | E04F 13/0892 52/126.1 |
| 2016/0369518 | A1 * | 12/2016 | Sarajian | E04F 21/22 |
| 2017/0044779 | A1 * | 2/2017 | Teng | E04F 21/1877 |
| 2018/0080237 | A1 * | 3/2018 | Chen | E04F 21/0092 |

FOREIGN PATENT DOCUMENTS

| | | | | |
|---|---|---|---|---|
| WO | WO-2016201502 | A1 * | 12/2016 | E04F 21/22 |
| WO | WO-2017195155 | A1 * | 11/2017 | E04F 21/0092 |

* cited by examiner

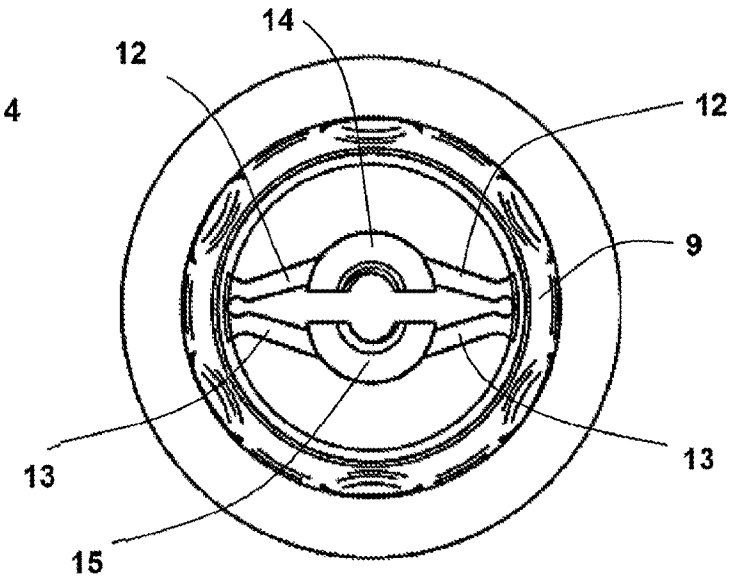
FIG. 14
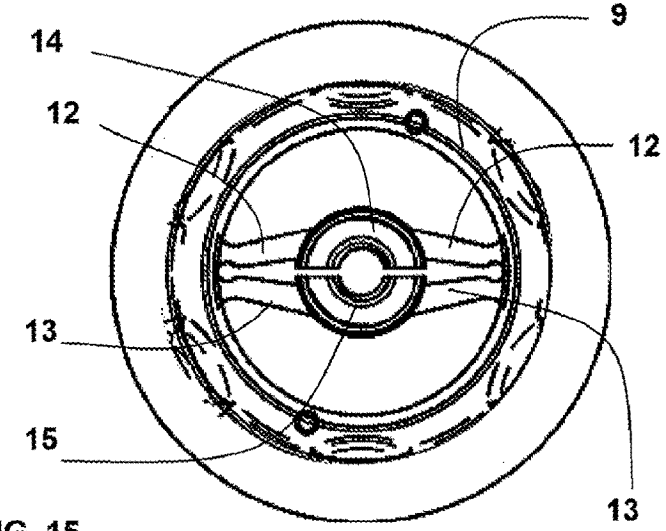
FIG. 15
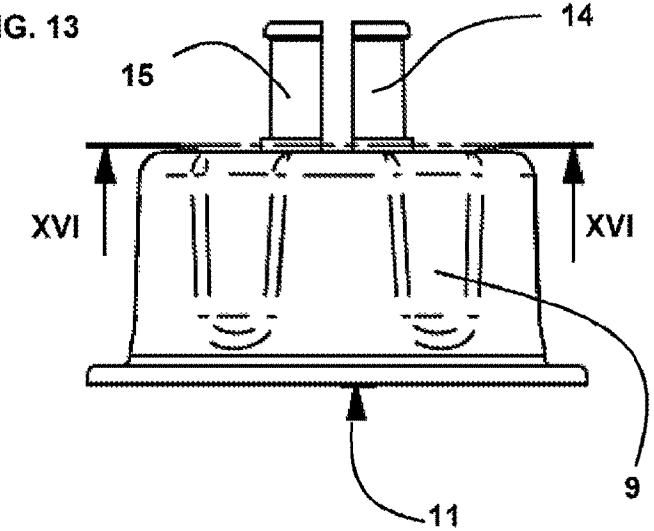
FIG. 13
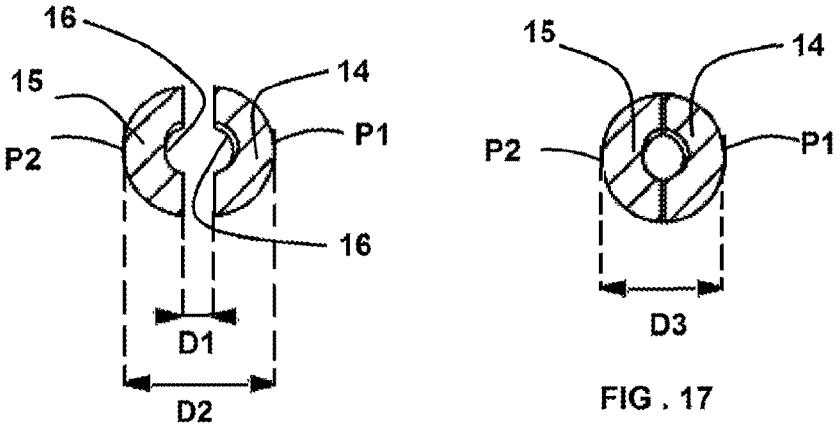
FIG. 16
FIG. 17

FIG. 27
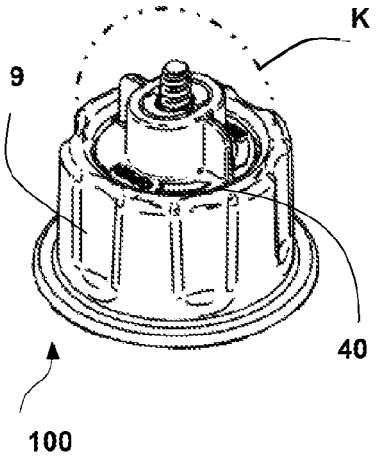
FIG. 28
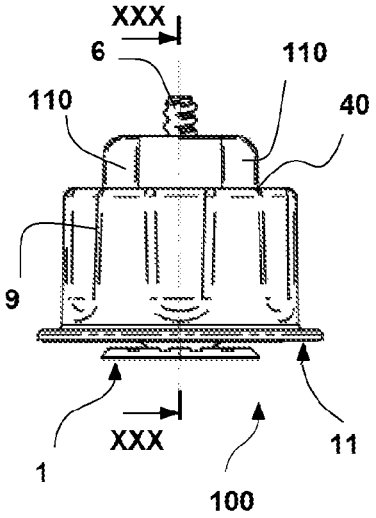
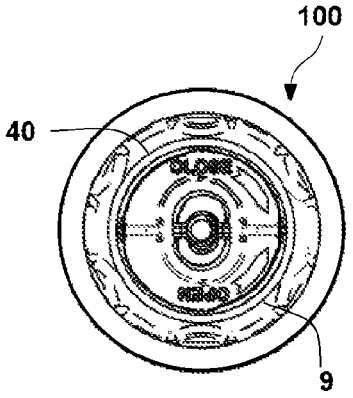
FIG. 29
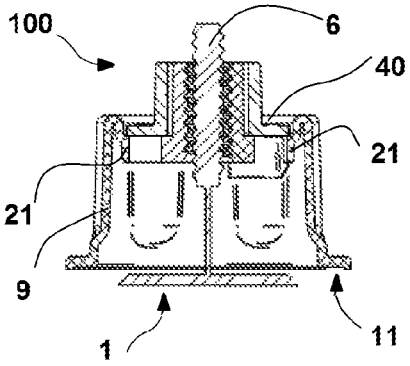
FIG. 30
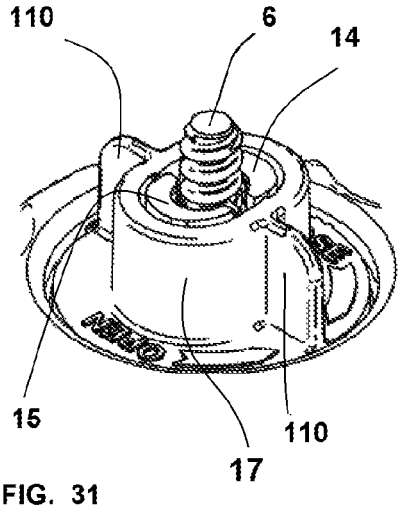
FIG. 31
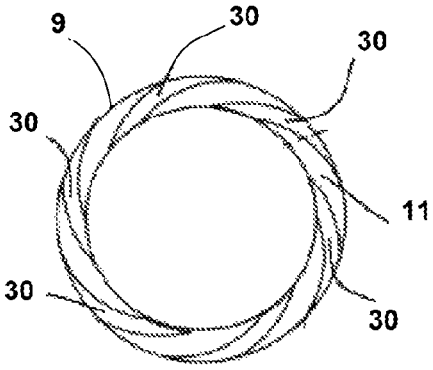
FIG. 32

KNOB COUPLABLE TO A SPACER-LEVELLER OF TILES FOR LAYING THE TILES ON FLAT SURFACES

The present invention relates to the technical sector concerning devices for laying tiles on planar surfaces, in particular on floors.

In order to obtain a result that is aesthetically valid, the laying of the tiles on a planar surface must be done to top specifications, i.e. the tiles must be arranged on a single plane and be regularly distanced from one another by regular gaps. Further, in order to contain labour costs, the laying of the tiles must be as simple and rapid as possible.

For this purpose, various tile alignment devices have been developed for laying tiles, on flat surfaces, in particular floors, which consist of a spacer-leveler and a knob couplable by screwing. With reference to FIG. 8, which illustrates an example of a spacer-leveler (1) of known type, the spacer-leveler (1) comprises: a rest wall (2), planar and having a relative lower surface (3) for facing a rest surface to be tiled covered with a layer of adhesive, and a relative and opposite upper surface (4), parallel to the lower surface; a separator member (7) which originates from the upper surface (4) of the rest wall (2), which extends for a relative height, and which comprises a plurality of lateral abutment surfaces (5) for, when the terminal regions of at least two tiles (not illustrated) are resting on the unoccupied portions of the upper surface (4) of the rest wall (2) with the relative lateral edges in contact with the plurality of abutment surfaces (5), separating the tiles at a predetermined distance; a threaded rod (6) perpendicular to the rest wall (2) which originates superiorly from the separator member (7). The separator member (7) is connected to the rest wall (2) or to the threaded rod (6) by a relative end of section able to function as a snap-off section 8.

The knob, instead, comprises: on a relative first side, a terminal surface arranged along a first plane; and a threaded conduit perpendicular to the first plane and accessible from the side of the knob so as to couple by screwing with the threaded rod (6) of the spacer-leveler for, when the terminal regions of at least two tiles are resting on the unoccupied portions of the upper surface (4) of the rest wall (2) with the relative lateral edges in contact with the plurality of abutment surfaces (5), crushing the at least two tiles between the upper surface (4) of the rest wall (2) and the terminal surface, aligning the tiles along a same plane.

After having screw-coupled the knob to the separator member (7), and having aligned the tiles, and having waited for the adhesive to take, by rapping the knob it is possible to separate the separator member (7) from the rest wall (2) or from the threaded rod (6), according to where the snap-off section (8) is arranged. In the first case the flooring will comprise only the rest wall (2), while in the second it will also comprise the separator member (7) which will then have to be covered with material for closing the gaps between the tiles.

To re-utilise a part of the alignment device, i.e. the knob, it will be necessary instead to unscrew the threaded rod (6) from the threaded conduit. This leads to time-wasting and therefore an additional cost because the threaded rod must be unscrewed manually or with the aid of pliers.

The aim of the present invention is to obviate the drawbacks of the prior art.

In particular, the invention aims at enabling easy re-utilisation and recycling of a part of the tile alignment device, and, in particular, a rapid and easy decoupling of the threaded rod (6) from the threaded conduit.

Further, one of the main objectives of the present invention consists in reducing labour and the costs relative to the laying of tiles.

These aims and objectives are obviated by a knob according to claim 1. This knob is couplable to a spacer-leveler of tiles for together defining a tile alignment device for the relative laying on flat surfaces.

According to the invention, once the alignment device has been utilised, and the snap-off section of the spacer-leveler broken off, it is therefore possible to rapidly and easily decouple the threaded rod from the threaded conduit without having to unscrew them from one another and without having recourse to use of pliers or other tools. This enables, with the purpose of re-utilisation, recycling the knob in a considerably shorter time as it is sufficient to change the arrangement of the first and second fixing means from the second to the first arrangement using the blocking element and leaving the threaded rod to fall. In the light of the foregoing, the laying of a flooring requires a very large number of tile alignment devices.

Additionally, according to the invention, the operator must not apply any pressure using the hands, neither on the knob nor on the threaded rod, nor for screwing the knob to the separator member, nor for extracting the threaded rod from the knob.

This simplifies the recycling operations of the knob and enables working in a more ergonomic way.

Specific embodiments of the invention will be described in the following part of the present description, according to what is set down in the claims and with the aid of the accompanying tables of drawings, in which:

FIGS. 13-14 are views, respectively lateral and from below, of the component of the knob of FIG. 9;

FIG. 15 is a view from below of the component of the knob of FIG. 9 in a second arrangement;

FIGS. 16 and 17 are sections, with respect to plane XVI-XVI of FIG. 13, of the components of the knob of FIGS. 14 and 15;

FIGS. 27-30 are views of a tile alignment device comprising a first embodiment of the knob according to the invention in an open configuration with the spacer-leveler for tiles of FIG. 8, respectively in a perspective view from above; lateral and from above and in section with respect to plane XXX-XXX of FIG. 28;

FIG. 31 is a larger-scale view of detail K of FIG. 27;

Figure 1:
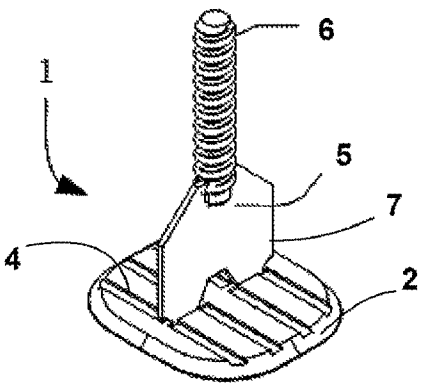
FIGS. 1-6 are views, respectively in perspective from above, in perspective from below, frontal, lateral, in section with respect to plane VI-VI of FIG. 5 of a spacer-leveler couplable with the knob of the invention.
Figure 2:
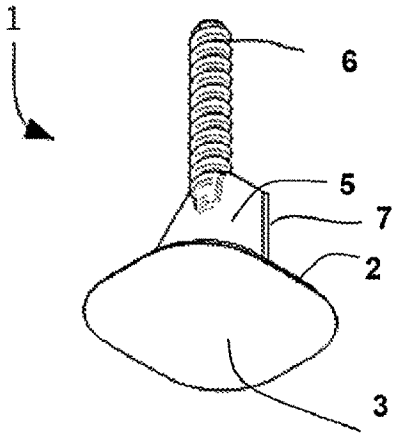
Figure 3:
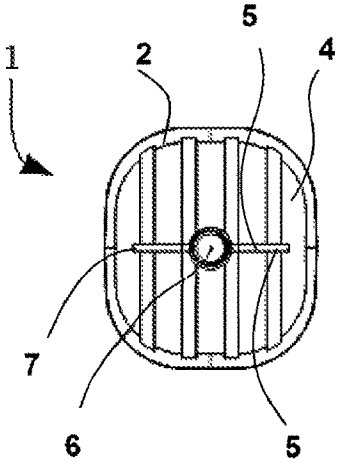
Figure 4:
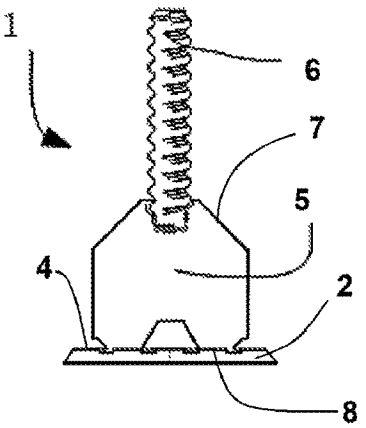
Figure 5:
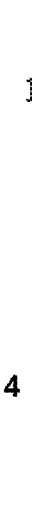
Figure 6:
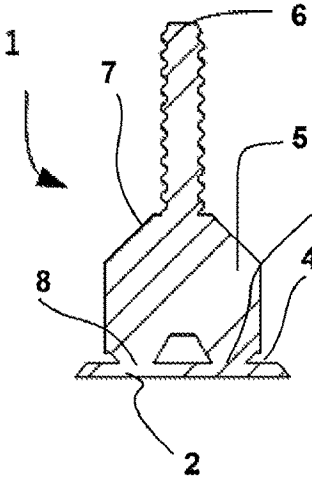
Figure 7:
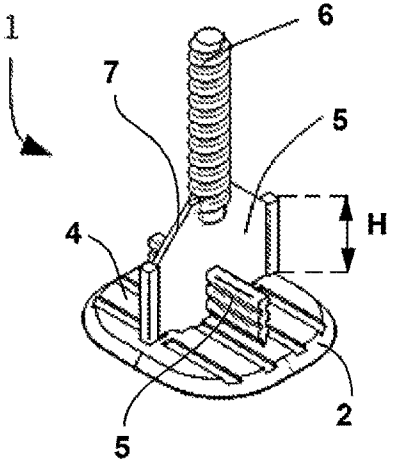
FIGS. 7-8 are perspective views of further spacers couplable with the knob of the invention.
Figure 8:
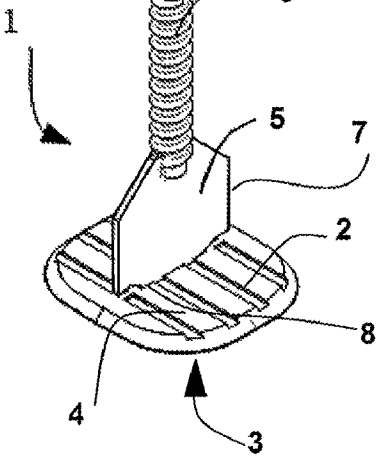
Figure 34:
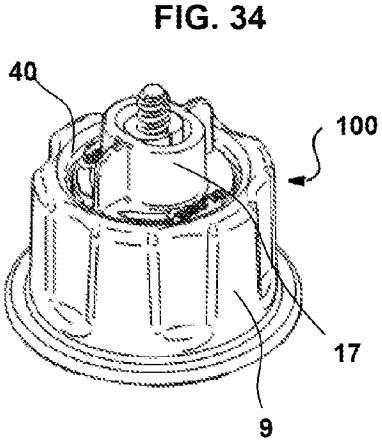
Figure 33:
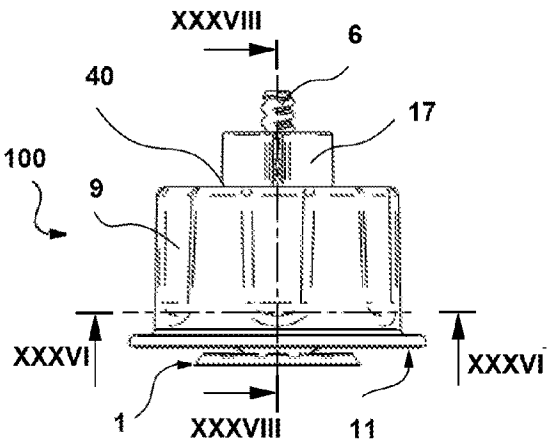
Figure 38:
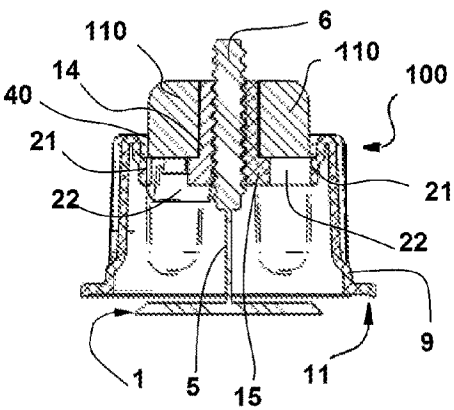
Figure 37:
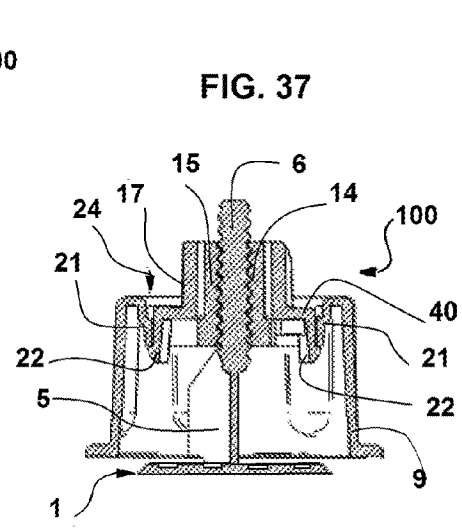
Figure 36:
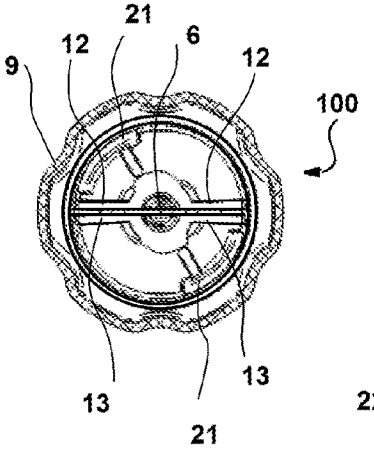
Figure 35:
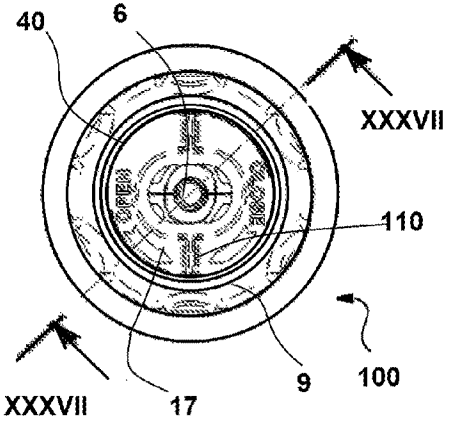

FIG. 32 is a view from below of the terminal surface of a second embodiment of the knob according to the invention; and FIGS. 33-39 are views of the tile alignment device comprising the first embodiment of the knob according to the invention in an open configuration with the spacer-leveler for tiles of FIG. 8, respectively frontal, in a perspective view from above; from above and in section with respect to plane XXXVI-XXXVI of FIG. 33; in section with respect to XXXVII-XXXVII of FIG. 35; and in section with respect to plane XXXVIII-XXXVIII of FIG. 35 and a larger-scale detail of FIG. 34.

With reference to the figures, reference numeral (1) denotes a spacer-leveler, (40) a knob according to the invention and (100) a tile alignment device for laying the tiles on flat surfaces that comprise the knob (40) according to the invention.

The knob (40) is couplable by screwing to a spacer-leveler (1) of tiles for together defining a tile alignment device for laying the tiles on flat surfaces, in which the spacer-leveler (1) is of known type alike to the ones described in the foregoing and comprises: a rest wall (2) which is planar and has a relative upper surface (4); a separator member (7) which originates from the upper surface (4) of the rest wall (2), which extends for a relative height (H) (see FIG. 7), and which comprises a plurality of lateral abutment surfaces (5); a threaded rod (6) perpendicular to the rest wall (2) which originates superiorly from the separator member (7); wherein the separator member (7) is connected to the rest wall (2) or the threaded rod (6) by a relative end of section able to function as a snap-off section (8). FIGS. 1-8 illustrate various types of spacer-leveler couplable to the knob (9) according to the invention.

Figure 9:
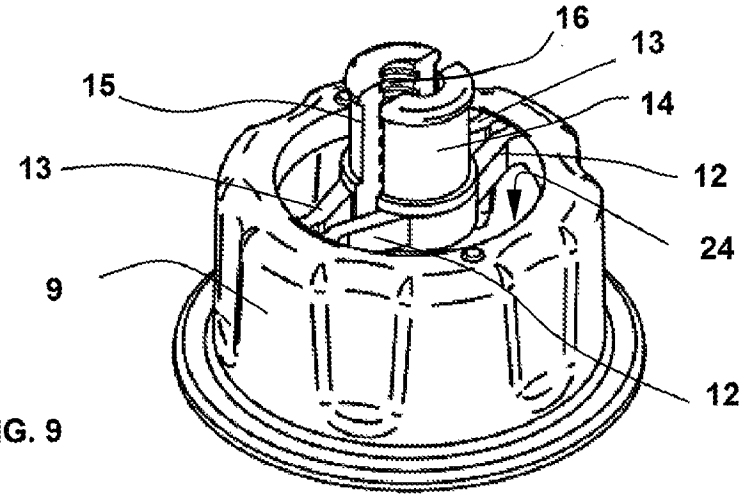
Figure 10:
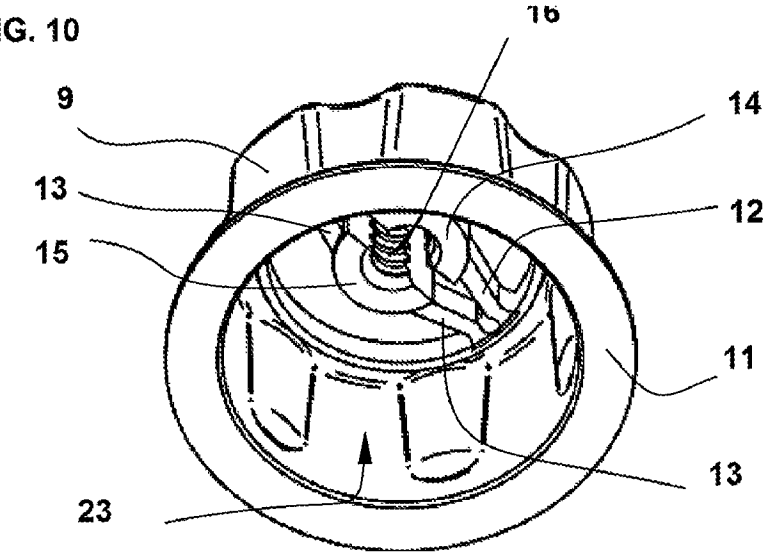
Figure 19:
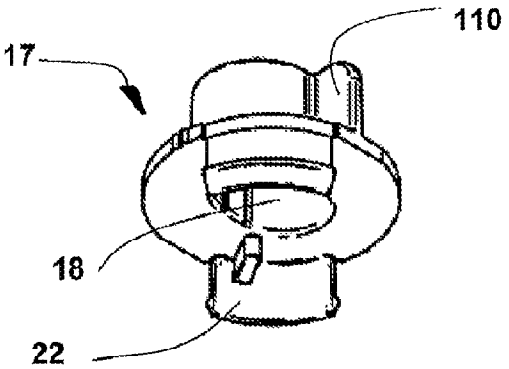
FIGS. 18-26 are views of a further component of the knob according to the invention respectively in perspective from above, in perspective from below, from above and in larger-scale, from below and in larger scale, in section with respect to XXII-XXII of FIG. 20, from a first side, from a second side, from a third side, and in section with respect to plane XXV-XXV of FIG. 25.

The knob (40) comprises: a relative body (9) having at a relative first side, a terminal surface (11) arranged along a plane; first and second connection means (12, 13) which originate from the body (9) of the knob (40); a first and a second fixing element (14, 15), each of which comprises a relative threaded slot (16) (FIG. 9) with a threading that is complementary to the threading of the threaded rod (6) of the spacer-leveler (1) and arranged perpendicularly to the plane, the first and second fixing elements (14, 15) being stably supported respectively by the first and second connection means (12, 13) in: a first relative arrangement (see FIGS. 9, 10, 12-14, 16 27-31) in which the relative threaded slots (16) are facing one towards another at a first distance (D1) (FIG. 16) so that the threaded rod (6) of said spacer-leveler (1) can be inserted in and extracted from between the threaded slots (16) without having to be screwed in or unscrewed; or in a second arrangement (see FIGS. 15, 17 and 34-39), in which the relative threaded slots (16) are facing one towards the other and arranged in such a way that the insertion in or extraction of the threaded rod (6) from the threaded slots (16) can take place only by screwing or unscrewing, wherein at least one from between the first and second connection means (12, 13) is elastically deformable, so as to enable the first and second fixing elements (14, 15) to change the arrangement thereof from the first to the second arrangement and vice versa; a blocking element (17), separated from the body (9) of the knob (40) and removably couplable to the first and second fixing elements (14, 15) or to the first and second connection means (12, 13) so as to elastically deform at least one from between the first and second connection means (12, 13) so as to change the arrangement of the first and second fixing elements (14, 15) from the first arrangement to the second arrangement, and vice versa, in order, when the terminal regions of at least two tiles are resting on the unoccupied portions of the upper surface (4) of the rest wall (2) of the spacer-leveler (1) with the relative lateral edges in contact with the plurality of abutment surfaces (5), to be able to insert, from the first side of the knob (40), the threaded rod (6) between the threaded slots (16) of the first and second fixing means in the relative first arrangement without screwing the threaded rod, and to be able, with the threaded rod (6) inserted, to arrange the first and second fixing elements (14, 15) in the relative second arrangement and screw the knob (40) to the threaded rod (6) so as to align the tiles between the upper surface (4) of the rest wall (2) and the terminal surface (11) along a same plane, and to be able, with the knob (40) screwed on, to arrange the first and second fixing elements (14, 15) in the relative first arrangement with the aim of being able to extract the threaded rod (6) from the two threaded slots (16) without unscrewing the threaded rod (6), once the snap-off section (8) of the spacer-leveler (1) has been fractured.

The threading of the threaded slots is preferably arranged superiorly of the terminal wall of the knob.

In a preferred embodiment, the first and second connection means (12, 13) stably support the first and second fixing elements (14, 15) in the relative first arrangement and the blocking element (17) is removably couplable to the first and second fixing elements (14, 15) or to the first and second connection means (12, 13), in order to, when the first and second fixing elements (14, 15) are in the relative first arrangement, elastically deform at least one from between the first and second connection means (12, 13) with the purpose of arranging the first and second fixing elements (14, 15) in the relative second arrangement. This enables inserting the threaded rod (6) between the threaded slots (16) without first having to couple the blocking element (17).

In this case, particular preference is given to a knob (40) wherein the first and second fixing elements (14, 15) each have a relative semi-tubular shape and a relative external lateral surface, wherein, in the relative first arrangement, the external surface of the first fixing element and the external surface of the second fixing element are at a second maximum distance (D2) (FIG. 16), measured in a relative direction along a plane that is transversal (XVI-XVI of FIG. 13) to the relative threading between a first and a second reference point (P1, P2) arranged respectively on the external surface of the first and second fixing elements (14, 15), wherein in the relative second arrangement the first and the second reference point (P1, P2) are at a third distance (D3) (FIG. 17) measured along said direction, wherein the blocking element (17) comprises a first hole (18) having a relative length (L1), greater than said second maximum distance (D2), and a relative width (L2) (obviously smaller than the length (L1) and equal to or greater than the distance D3), for receiving the first and second fixing elements (14, 15) in the first arrangement thereof with said second maximum distance (D2) arranged parallel to the length (L1) of the first hole (18), and wherein the width (L2) is such as to enable a partial rotation of the blocking element (17), around the first and second fixing elements (14, 15), from a first insertion position (FIGS. 27-31) to a second blocking position (FIGS. 35-39), so as to deform the first and/or second connection means (12, 13) in order to arrange and maintain the first and second fixing elements (14, 15) in the relative second arrangement.

The first and second fixing elements (14, 15) preferably project superiorly from the body (9) of the knob (40) so as to be more easily couplable to the blocking element (17).

Figure 21:
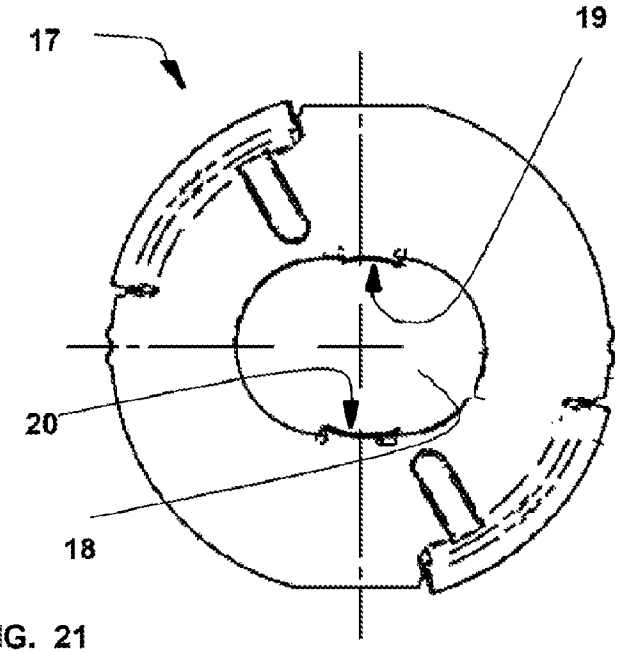
Figure 18:
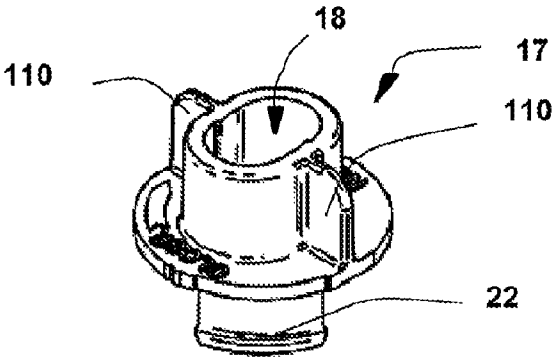
Figure 20:
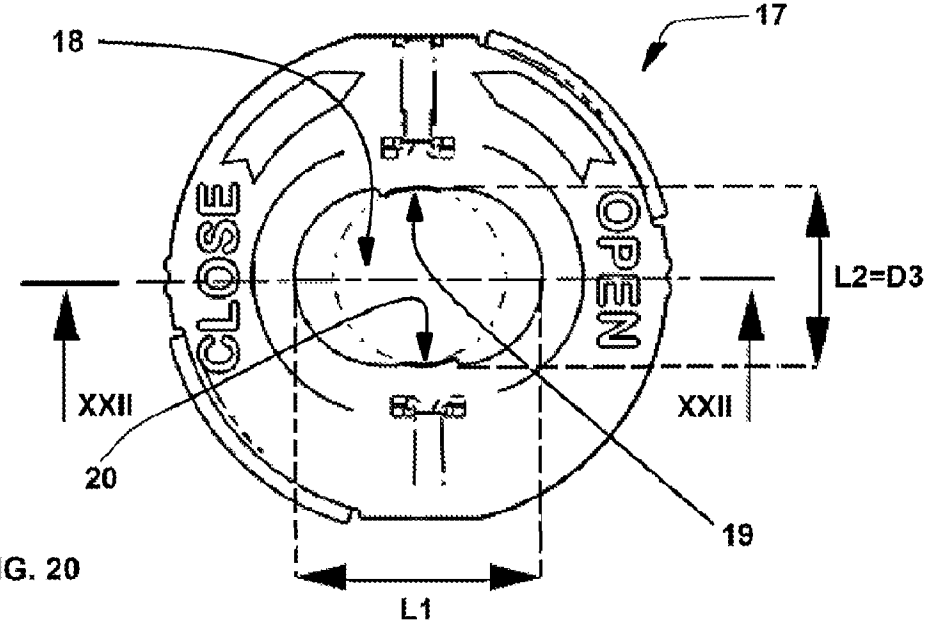
Figure 25:
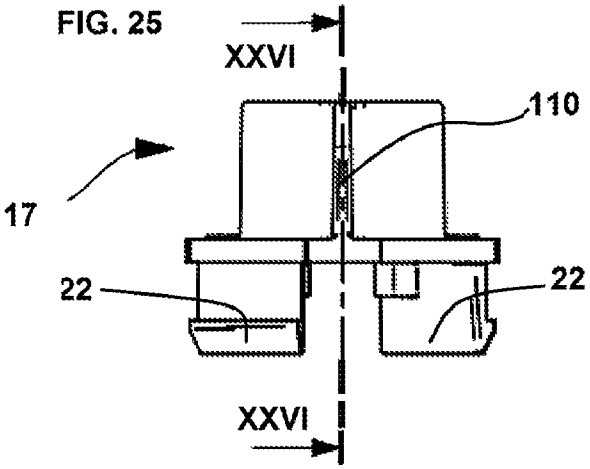
Figure 26:
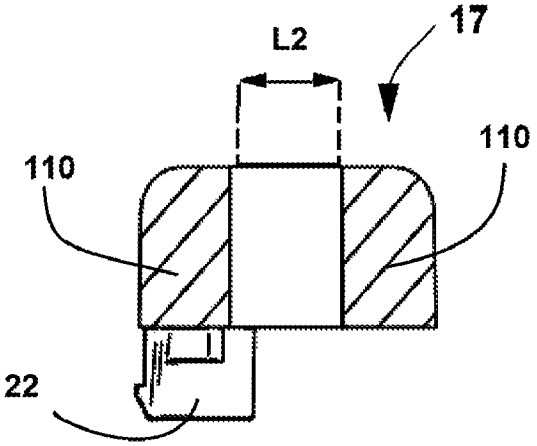
Figure 24:
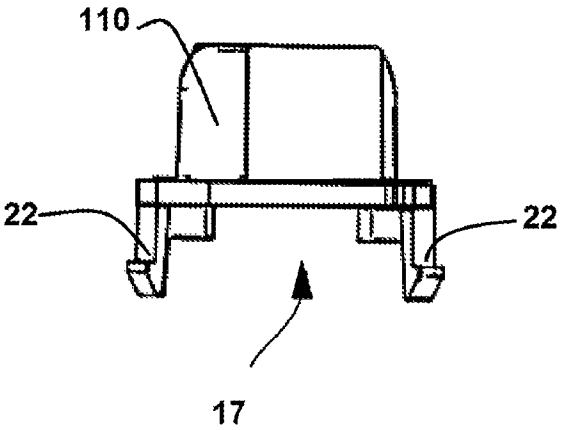
Figure 22:
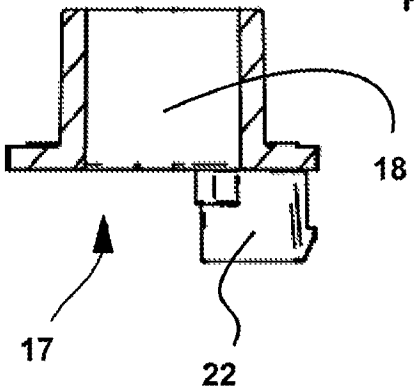
Figure 23:
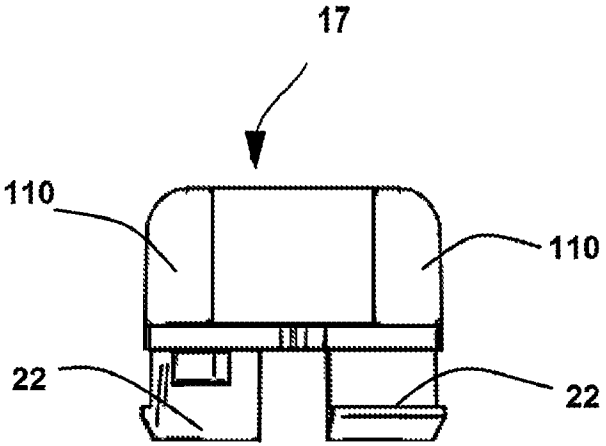
Figure 39:
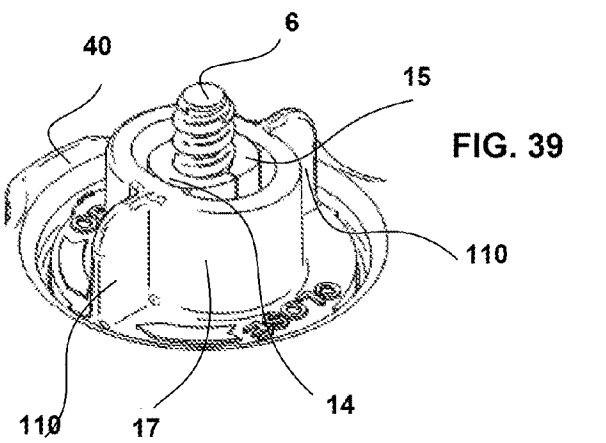

The shape of the first and second fixing elements (14, 15) is advantageously cylindrical semi-tubular with a relative external first diameter equal to the third distance (D3), and the first hole (18) of the blocking element (17) comprises a relative tubular internal wall which has a first and a second portion (19, 20) (see FIGS. 20, 21) which are opposite one another, and conformed as longitudinal sections of an external surface of a cylindrical tube having a diameter that is substantially identical to the first diameter, so as, when the blocking element (17) is in the relative blocking position, to face and partly contact the external lateral surface of the first and second fixing elements (14, 15) in the relative second arrangement. This enables an easy passage from the first configuration to the second configuration, and maintaining the second configuration during the screwing of the knob (40) to the spacer-leveler (1).

In this case, the first connection means (12) can comprise a relative first and a relative second arm (12, 12), each of which originates from the body (9) of the knob (40) and terminates at an end of the first fixing element (14) that is semi-tubular and cylindrical, the ends being arranged substantially diametrically opposite to one another. Likewise, the second connection means (13) can comprise a relative first and a relative second arm (13, 13), each of which originates from the body (9) of the knob (40) and terminates at an end of the second fixing element (15) that is semi-tubular and cylindrical, the ends being arranged substantially diametrically opposite to one another. The points originating the first arms of the first and second connection means (12, 13) are advantageously adjacent to one another. Likewise the points originating the second arms of the first and second connection means (12, 13) are adjacent to one another.

In an advantageous embodiment of the knob (40), the relative body (9) comprises first retaining means (21), the blocking element (17) comprises second retaining means (22) for, when the first and second fixing elements (14, 15) are received in the first hole (18) and arranged in the relative second arrangement, coupling to the first retaining means (21) so as to retain the blocking element (17) in the relative second position while the knob (40) screws to the rod of the spacer-leveler (1). This ensures that the knob (40) does not de-assemble during the screwing.

In this embodiment the second retaining means (22) can be advantageously arranged below the tubular wall of the blocking element (17) and advantageously originate from the tubular wall.

The blocking element (17) advantageously comprises relative external lateral tabs (110) which facilitate the rotation thereof about the first and second fixing elements (14, 15) as they enable leverage to be applied on the tabs (110) during the rotation. The tabs (110) are advantageously two in number and are arranged radially and oppositely.

Figure 11:
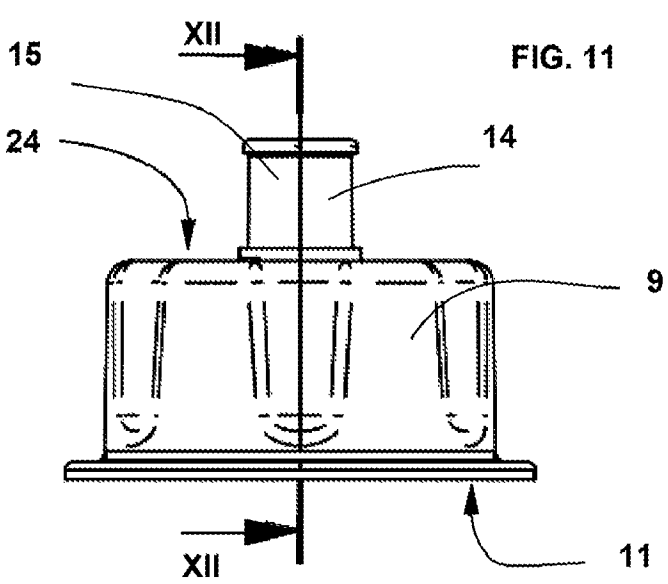
FIGS. 9-12 are views, respectively in perspective from above, in perspective from below, frontal, lateral, in section with respect to plane XII-XII of FIG. 11 of a first component of a first embodiment of the knob according to the invention in a relative first arrangement.
Figure 12:
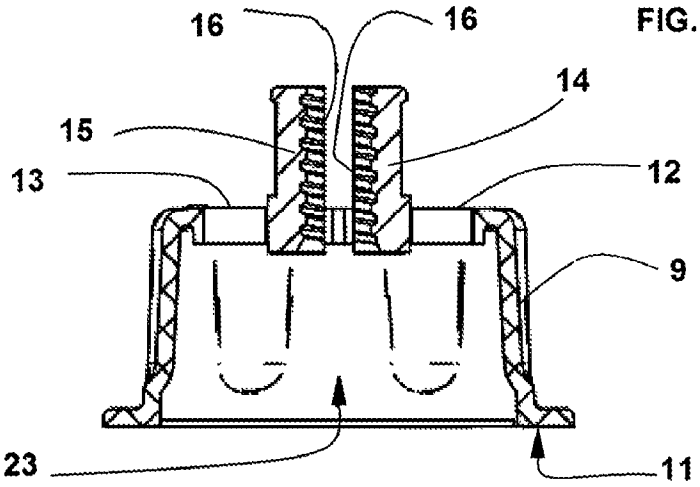

The body (9) of the knob (40) preferably forms a second hole (23) (FIGS. 10 and 11), which is a through-hole and is accessible from the first side of the knob (40) and from a second side opposite the first side at a relative opening (24) (FIGS. 9 and 37), wherein the first retaining means (21) are arranged internally of the second hole (23) in proximity of the opening (24), wherein the first and second connection means (12, 13) originate from the body (9) of the knob (40) at the opening (24), wherein the first and second fixing elements (14, 15) extend superiorly of the opening (24), wherein the blocking element (17) comprises a tubular portion for receiving the first and second fixing elements (14, 15) and the second retaining means (22) comprise a first and a second retaining element arranged inferiorly of the tubular portion, on opposite sides, in such a way as to enable insertion of the first and second fixing elements (14, 15) in the relative first arrangement in the first hole (18) of the blocking element (17) and the insertion of the first and second retaining element in the second hole (23) of the body (9) of the knob (40) through the opening (24), and wherein the second retaining means are couplable by interference with the first retaining means (21) when the blocking element (17) is positioned in the relative second position so as to retain the blocking element (17) in the relative second position. This embodiment enables an easy realisation of the retaining means.

During the coupling of the knob (40) to the spacer-leveler (1) as the terminal surface (11) of the knob (40) progressively nears the surface of the tiles resting on the spacer-leveler (1), any solid particles present on the surface of the tiles can be crushed and scratch the tiles.

To avoid damage to the tiles, the terminal surface (11) of the body (9) of the knob (40) preferably has a plurality of concavities for receiving any solid particles present on the upper surface of the tiles while the threaded conduit, defined by the first and second fixing element (12, 13) in the relative second arrangement, is screwed to the threaded rod (6). In this way the particles can be received in the housings afforded in the terminal surface 11, preventing crushing them between the terminal surface 11 of the knob 40 and the tiles. Therefore the replacement of already-laid and scratched tiles is avoided, further reducing labour and laying costs and improving the overall alignment of the tiles.

As illustrated in FIG. 32, the terminal surface (11) of the body (9) of the knob (40) is advantageously annular and the concavities are conformed as open channels (30) which extend from an internal perimeter of the ring to an external perimeter of the ring in order to facilitate the exit of the particles from the open channels (30) during the screwing-in of the knob (40) to the spacer-leveler (1). More preferably, the open channels (30) are conformed as an arc of circle having a centre thereof offset with respect to the threaded conduit, wherein the threaded conduit has a relative threading direction, and said arcs have relative concavities arranged upstream with respect to the threading direction so as to facilitate the exit of any particles towards the outside of the knob (40) during the screwing-in of the knob (40) to the spacer-leveler (1).

In a further embodiment, the open channels (30) can be arranged in spoke fashion. The concavities (30) advantageously have a relative depth of at least 0.5 mm, more advantageously comprised between 0.5 and 3 mm, between 0.5 and 2 mm, and between 0.8 and 2 mm, in order also to house particles of non-insignificant size.

The concavities (30) preferably have a relative area of at least 4 $mm^2$, more preferably of at least 9 $mm^2$, advantageously of 15-30 $mm^2$, in particular when the concavities are open channels (30).

The open channels (30) preferably have a relative width of at least 1 mm, preferably of at least 2.5 mm, more preferably at least 3 mm, advantageously of 4-7 mm.

Particularly preferable is a tile alignment device for laying the tiles on flat surfaces, comprising a spacer-leveler (1) of tiles as previously described and a knob (40) according to the invention.

The foregoing is understood to have been described by way of non-limiting example, and any variants of a practical-applicational nature are understood to fall within the scope of protection as claimed in the following.

The invention claimed is:

1. A knob couplable by screwing, to a spacer-leveler of tiles for together defining a tile alignment device for laying the tiles on flat surfaces, the spacer-leveler comprising:

a rest wall which is planar and which has a relative respective upper surface;

a separator member which originates from the upper surface of the rest wall, which extends for a respective height, and which comprises a plurality of lateral abutment surfaces;

a threaded rod perpendicular to the rest wall which originates from the separator member;

wherein the separator member is connected to the rest wall or the threaded rod by a respective end of section able to function as a snap-off section, the knob comprising:

a respective body having at a respective first side, a terminal surface arranged along a plane;

first and second connection means which originate from the body of the knob;

a first and a second fixing element, each of which comprises a respective threaded slot with a threading that is complementary to the threading of the threaded rod of the spacer-leveler and arranged perpendicularly to the plane, the first and second fixing elements being stably supported respectively by the first and second connection means in: a first respective arrangement in which respective threaded slots are facing one towards the other at a first distance so that the threaded rod of said spacer-leveler can be inserted in and extracted from between the threaded slots without having to be screwed in or unscrewed;

or in a second arrangement in which the respective threaded slots are facing one towards the other and arranged in such a way that the insertion in or extraction of the threaded rod from the threaded slots can take place only by screwing or unscrewing, wherein at least one from between the first and second connection means is elastically deformable, so as to enable the first and second fixing elements to change the arrangement thereof from the first to the second arrangement and vice versa;

a blocking element, separated from the body of the knob and removably couplable to the first and second fixing elements or to the first and second connection means so as to elastically deform at least one from between the first and second connection means so as to change the arrangement of the first and second fixing elements from the first arrangement to the second arrangement, and vice versa, in order, when the terminal regions of at least two tiles are resting on the unoccupied portions of the upper surface of the rest wall of the spacer-leveler with the respective lateral edges in contact with the plurality of abutment surfaces, to be able to insert, from the first side of the knob, the threaded rod between the threaded slots of the first and second fixing means in the respective first arrangement without screwing the threaded rod, and to be able, with the threaded rod inserted, to arrange the first and second fixing elements in the respective second arrangement and screw the knob to the threaded rod so as to align the tiles between the upper surface of the rest wall and the terminal surface along a same plane, and to be able, with the knob screwed on, to arrange the first and second fixing elements in the respective first arrangement with the aim of being able to extract the threaded rod from the two threaded slots without unscrewing the threaded rod, once the snap-off section of the spacer-leveler has been fractured.

2. The knob of claim 1, wherein the first and second connection means stably support the first and second fixing elements in the respective first arrangement and wherein the blocking element is removably couplable to the first and second fixing elements or to the first and second connection means, in order to, when the first and second fixing elements are in the respective first arrangement, elastically deform at least one from between the first and second connection means with the purpose of arranging the first and second fixing elements in the respective second arrangement.

3. The knob claim 2, wherein the first and second fixing elements each have a respective semi-tubular shape and a respective external lateral surface, wherein, in the respective first arrangement, the external surface of the first fixing element and the external surface of the second fixing element are at a second maximum distance, measured in a respective direction along a plane that is transverse to a respective threading between a first and a second reference point arranged respectively on the external surface of the first and second fixing elements, wherein in the respective second arrangement the first and the second reference point are at a third distance measured along said direction, wherein the blocking element comprises a first hole having a respective length, greater than said second maximum distance, and a respective width, for receiving the first and second fixing elements in the first arrangement thereof with said second maximum distance arranged parallel to the length of the first hole, and wherein the width of the first hole is such as to enable a partial rotation of the blocking element, around the first and second fixing elements, from a first insertion position to a second blocking position, so as to deform the first and/or second connection means in order to arrange and maintain the first and second fixing elements in the respective second arrangement.

4. The knob of claim 3, wherein the shape of the first and second fixing elements is cylindrical semi-tubular with a respective external first diameter equal to the third distance, and wherein the first hole of the blocking element comprises a respective tubular internal wall which has a first and a second portion which are opposite one another, and conformed as longitudinal sections of an external surface of a cylindrical tube having a diameter that is substantially identical to the first diameter, being the third distance, so as, when the blocking element is in the respective blocking position, to face and partly contact the external lateral surface of the first and second fixing elements in the respective second arrangement.

5. The knob of claim 3, wherein the blocking element comprises second retaining means for, when the first and second fixing elements are received in the first hole and arranged in the respective second arrangement, coupling to first retaining means so as to retain the blocking element in the respective second position while the knob screws to the rod of the spacer-leveler.

6. The knob of claim 3, wherein the body of the knob forms a second hole, which is a through-hole and is accessible from the first side of the knob and from a second side opposite the first side at a respective opening, wherein the first retaining means are arranged internally of the second hole in proximity of the opening, wherein the first and second connection means originate from the body of the knob at the opening, wherein the first and second fixing elements extend of the opening, wherein the blocking element comprises a tubular portion for receiving the first and second fixing elements and the second retaining means comprise a first and a second retaining element arranged inferiorly of the tubular portion, on opposite sides, in such a way as to enable insertion of the first and second fixing elements in the respective first arrangement in the first hole of the blocking element and the insertion of the first and second retaining element in the second hole of the body of the knob through the opening, and wherein the second retaining means are couplable by interference with the first retaining means when the blocking element is positioned in the respective second position so as to retain the blocking element in the respective second position.

7. The knob of claim 1, wherein, in the respective second arrangement, the first and second fixing elements define a threaded conduit and wherein the terminal surface of the body of the knob has a plurality of concavities for receiving any solid particles present on the upper surface of the tiles while the threaded conduit is screwed to the threaded rod.

8. The knob of claim 7, wherein the terminal surface of the body of the knob is annular and the concavities are conformed as open channels which extend from an internal perimeter of the ring to an external perimeter of the ring in order to facilitate the exit of the particles from the open channels during the screwing-in of the knob to the spacer-leveler.

9. The knob of claim 8, wherein the open channels are conformed as an arc of circle having a centre thereof offset with respect to the threaded conduit, wherein the threaded conduit has a respective threading direction, and said arcs have respective concavities arranged upstream with respect to the threading direction so as to facilitate the exit of any particles towards the outside of the knob during the screwing-in of the knob to the spacer-leveler.

10. A tile alignment device for laying tiles on flat surfaces, comprising a spacer-leveler of tiles and a knob according to claim 1.

* * * * *